US006390596B1

(12) United States Patent
Jeon

(10) Patent No.: US 6,390,596 B1
(45) Date of Patent: May 21, 2002

(54) METHOD FOR HOMING HEAD IN INK-JET PRINTING SYSTEM

(75) Inventor: Cheol-Min Jeon, Kumi-shi (KR)

(73) Assignee: Samsung Electronics Co. Ltd., Suwon (KR)

( * ) Notice: Subject to any disclaimer, the term of this patent is extended or adjusted under 35 U.S.C. 154(b) by 0 days.

(21) Appl. No.: 09/217,614

(22) Filed: Dec. 22, 1998

(30) Foreign Application Priority Data

Dec. 22, 1997 (KR) ..... 97-71940

(51) Int. Cl.[7] ..... B41J 23/00
(52) U.S. Cl. ..... 347/37; 400/313
(58) Field of Search ..... 347/23, 32, 37, 347/29; 400/313

(56) References Cited

U.S. PATENT DOCUMENTS

| | | | | |
|---|---|---|---|---|
| 4,167,345 A | | 9/1979 | Englund et al. | 400/588 |
| 4,401,990 A | * | 8/1983 | Aiba et al. | 347/33 |
| 4,577,203 A | * | 3/1986 | Kawamura | 347/30 |
| 5,074,690 A | | 12/1991 | Del Signore, II et al. | 400/322 |
| 5,158,379 A | | 10/1992 | Moriya et al. | 400/279 |
| 5,182,583 A | * | 1/1993 | Horigome et al. | 347/19 |
| 5,605,407 A | | 2/1997 | Hama et al. | 400/705.1 |
| 5,668,580 A | | 9/1997 | Chan et al. | 347/37 |
| 5,825,381 A | | 10/1998 | Choo | 347/37 |
| 5,861,898 A | * | 1/1999 | Nakanashi | 347/19 |

FOREIGN PATENT DOCUMENTS

| | | | | |
|---|---|---|---|---|
| JP | 4-220351 | * | 8/1992 | 347/23 |

* cited by examiner

*Primary Examiner*—Craig A. Hallacher
(74) *Attorney, Agent, or Firm*—Robert E. Bushnell, Esq.

(57) ABSTRACT

A method for transporting an ink-jet head in an ink-jet printing system to the home position by use of driving voltage charged in the ink-jet printing system in the ink-jet printing system when power supply is cut off. The method for transporting the ink-jet head in the printing system to the home position when the power supply is cut off, by charging a storage unit with power from a power supply, when a level of the voltage drops to less than a reference voltage level during the printing operation, by stopping the printing operation, and transferring the ink-jet head to its home position by use of the storage units charged voltage.

20 Claims, 3 Drawing Sheets

METHOD FOR HOMING HEAD IN INK-JET PRINTING SYSTEM

CLAIM OF PRIORITY

This application makes reference to, incorporates the same herein, and claims all benefits accruing under 35 U.S.C. § 119 from an application entitled Method For Homing Head in Ink-jet Printing System earlier filed in the Korean Industrial Property Office on the 22$^{nd}$ day of December 1997, and there duly assigned, Ser. No. 71940/1997, a copy of which is annexed hereto.

BACKGROUND OF THE INVENTION

1. Technical Field

The present invention relates to a printing system having an ink-jet head, and more particularly, the present invention relates to a method for homing the ink-jet head in the printing system when power supply is cut off.

2. Related Art

A printer is an image formation device which receives data from a host system such as a computer system and then forms a corresponding image onto a sheet of paper.

Generally, a printing system having an ink-jet head is capable of performing its printing operation for characters and pictures through jetting ink via the ink-jet head. The printing system includes an ink-jet printer for printing image data provided from a computer system such as a notebook computer or a desktop computer and also includes an ink-jet facsimile machine for printing the image data to be received or copied thereto.

There is a problem with the printing system or facsimile machine performing its printing operation by use of the ink-jet head in that it discontinues its operation at the currently working place when the power supply is cut off due to power failure. If the ink-jet head discontinues its operation, it cannot work until the power supply is re-provided thereto. It causes the ink included in the ink-jet head to be dried so that the ink is unnecessarily wasted, and that a nozzle of injecting the ink therefrom is blocked up due to the dried ink. As a result, when the printing operation is to be continually performed according to the power supply re-provided to the ink-jet head, the ink cannot be normally jetted via the nozzle to thereby damage the image quality.

I have found that the aforementioned problems can be extremely inconvenient. Efforts have been made to reduce problems in related arts.

Exemplars of recent efforts in the art include U.S. Pat. No. 5,825,381 for *Home Position Sensor System For Positioning Print Carriage And Method Thereof* issued to Choo, U.S. Pat. No. 5,668,580 for *De-Coupleable Print Position Indicator* issued to Chan et la., U.S. Pat. No. 5,605,407 for *Printer And Its Control Method* issued to Hama et al., U.S. Pat. No. 5,158,379 for *Printing Starting Position Controller for Serial Printer* issued to Moriya et al., U.S. Pat. No. 5,074,690 for *Print Head Carriage Homing, System* issued to Del Signore, II et al., and U.S. Pat. No. 4,167,345 for *Printing Apparatus with Selectively Movable Printing Heads* issued to Englund et al.

While these recent efforts provide advantages, I note that they fail to adequately provide a method for efficiently and conveniently solving aforementioned problems pertaining to dried ink.

SUMMARY OF THE INVENTION

It is therefore an object of the present invention to provide a method for homing an ink-jet head in an ink-jet printing system by use of driving voltage charged therein when the power supply is cut off, and to reduce the occurrence of blockages of nozzles of an ink-jet head due to dried ink.

To achieve the above objects and others, there is provided with a method for a method for homing the ink-jet head in the printing system when the power supply is cut off, including the steps of charging a given voltage with power supply provided thereto; when a level of the voltage drops less than a reference voltage level during the printing operation, stopping the printing operation; and transferring the ink-jet head to its primary position by use of the charged voltage.

To achieve these and other objects in accordance with the principles of the present invention, as embodied and broadly described, the present invention provides a method, comprising: storing power in a storage unit of an image formation apparatus when said image formation apparatus receives the power; when the power received by said image formation apparatus drops below a predetermined level during a printing operation, stopping the printing operation; and transporting a print head of said image formation apparatus to a predetermined position by use of the power stored in said storage unit.

To achieve these and other objects in accordance with the principles of the present invention, as embodied and broadly described, the present invention provides a method, comprising: storing first power into a storage unit of an image formation apparatus, said first power being outputted from a power supply, said power supply outputting a plurality of voltages; checking when at least one of said plurality of voltages outputted from said power supply drops below a predetermined voltage level during a printing operation of said image formation apparatus, said checking being performed by a voltage detector; stopping said printing operation when said at least one of said plurality of voltages outputted from said power supply drops below said predetermined voltage level during said printing operation; detecting a position of a print head of said image formation apparatus; and transporting said print head to a predetermined position by use of said first power stored in said storage unit.

To achieve these and other objects in accordance with the principles of the present invention, as embodied and broadly described, the present invention provides an apparatus, comprising: a power supply supplying a first power and storing a second power; an image formation unit forming an image on a recordable medium when said power supply supplies said first power to said image formation unit; a print head of said image formation unit being positioned adjacent to a surface of the recordable medium to form said image on the recordable medium; a voltage detector detecting a voltage level of said first power supplied by said power supply; and said print head being transported to a predetermined position when said voltage detector detects that said voltage level of said first power supplied by said power supply drops below a predetermined level, said print head being transported to said predetermined position by use of said second power stored by said power supply.

The present invention is more specifically described in the following paragraphs by reference to the drawings attached only by way of example. Other advantages and features will become apparent from the following description and from the claims.

BRIEF DESCRIPTION OF THE DRAWINGS

In the accompanying drawings, which are incorporated in and constitute a part of this specification, embodiments of the invention are illustrated, which, together with a general description of the invention given above, and the detailed description given below serve to exemplify the principles of this invention.

DETAILED DESCRIPTION OF THE PREFERRED EMBODIMENT

While the present invention will be described more fully hereinafter with reference to the accompanying drawings, in which a preferred embodiment of the present invention is shown, it is to be understood at the outset of the description which follows that persons of skill in the appropriate arts may modify the invention here described while still achieving the favorable results of this invention. Accordingly, the description which follows is to be understood as being a broad, teaching disclosure directed to persons of skill in the appropriate arts, and not as limiting upon the present invention.

In the following description, numerous specific details such as components and frequencies of the concrete circuit, are set forth to provide a more thorough understanding of the present invention. It will be apparent, however, to one skilled in the art that the present invention may be practiced without these specific details. The detailed description of known function and constructions unnecessarily obscuring the subject matter of the present invention will be avoided in the present invention.

Figure 1:
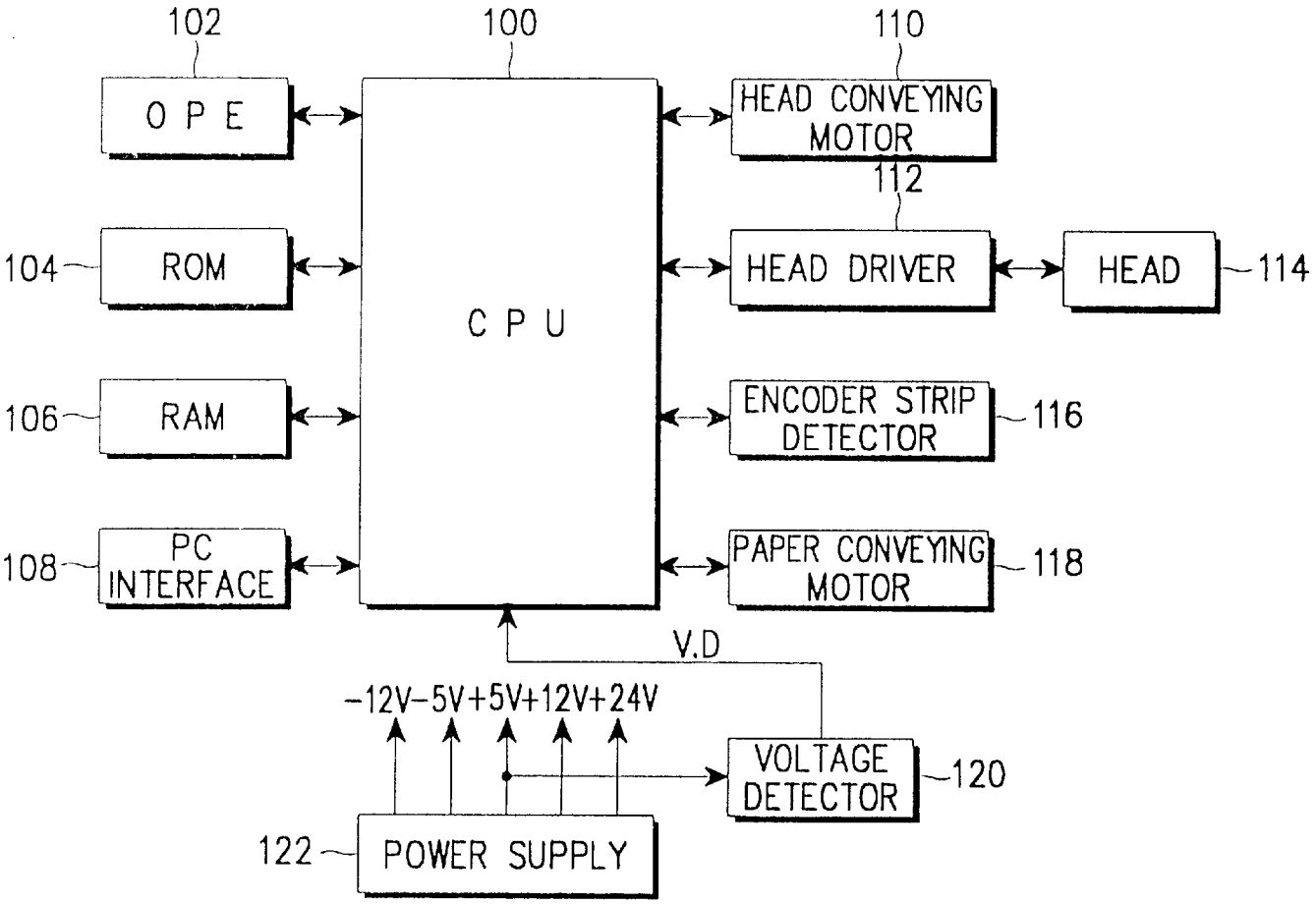
FIG. 1 is a block diagram illustrating the construction of an ink-jet printer, in accordance with the principles of the present invention.

FIG. 1 is a block diagram illustrating the construction of an ink-jet printer according to an embodiment of the present invention, which includes: a central processing unit (CPU) 100; operating panel equipment (OPE) 102; a read only memory (ROM) 104; a random access memory (RAM) 106; a personal computer interface 108; a head conveying motor 110; a head driver 112; an ink-jet head 114; an encoder strip detector 116; a paper conveying motor 118; a voltage detector 120; and a power supply 122.

The central processing unit 100 controls overall operations of the ink-jet printer according to a control program stored in the read only memory 104 as a program memory. Particularly, it performs its control operation for homing the ink-jet head when the power supply is cut off, according to an embodiment of the present invention. The operating panel equipment 102 includes a plurality of function keys for inputting various commands and a display for displaying a current state of the ink-jet printer.

The display included in the operating panel equipment 102 can be a cathode ray tube, a liquid crystal display, a gas-plasma display, a light emitting diode display, an electro-luminescent display, or an field emission display.

The read only memory 104 stores the control program requested for the central processing unit 100 to allow the ink-jet printer to perform its operation. The random access memory 106 temporally stores the data generated according the operation of the ink-jet printer. The personal computer interface 108 connected to the personal computer (not shown) via a parallel port, interfaces a printing data and control data in connection with the above personal computer. The head conveying motor 110 includes a motor control circuit and a conveying motor. Here, the above motor control circuit is for controlling the conveying motor under the control of the central processing unit 100 and the above conveying motor is for conveying the ink-jet head 114 to left and right under the control of the motor control circuit. Generally, the conveying motor uses a direct current (DC) motor.

In the meanwhile, the head driver 112 drives the ink-jet head 114 according to the control of the central processing unit 100, which is comprised of a transmitter for transmitting the image data to be printed to the ink-jet head 114 and a nozzle driver for driving each nozzle of the ink jet head 114 according to the transmitted image data. Here, the ink-jet head 114 is of a recording device for recording the image onto printing papers, which directly injects the ink onto the paper under the control of the head driver 112. The encoder strip detector 116 detects a strip variation via a sensor when the ink-jet head 114 is transferred by the head conveying motor 110. It can detect the position of the ink-jet head 114 through counting the number of the strip variation. Further, the encoder strip detector 116 can sense the driving speed of the head conveying motor 110 through detecting the speed of the strip variation. The paper conveying motor 118 conveys the paper for recording the image data under the control of the central processing unit 100, which is comprised of a motor and a motor control circuit. Here, the above paper conveying motor 118 uses a step motor. The power supply 122 converts an alternating current (AC) into a direct current (DC) requested for the ink-jet printer to thereby provide the converted direct current of a driving voltage for all elements included in the ink-jet printer. For example, ±12 volts, ±5 volts, and +24 volts as shown in FIG. 1. The voltage detector 120 senses whether a level of voltage 5 volts applied from the power supply 122 drops less than that of a given voltage 4.75 volts. When sensed that the level of the voltage 5 volts dropped less than that of the given voltage 4.75 volts, a detecting signal is provided with the central processing unit 100. Meanwhile, the aforesaid elements included in the ink-jet printer get a supply of the driving voltage with the direct current outputted from the power supply 122. For example, ±12 volts, ±5 volts, and +24 volts as shown in FIG. 1.

Figure 2:
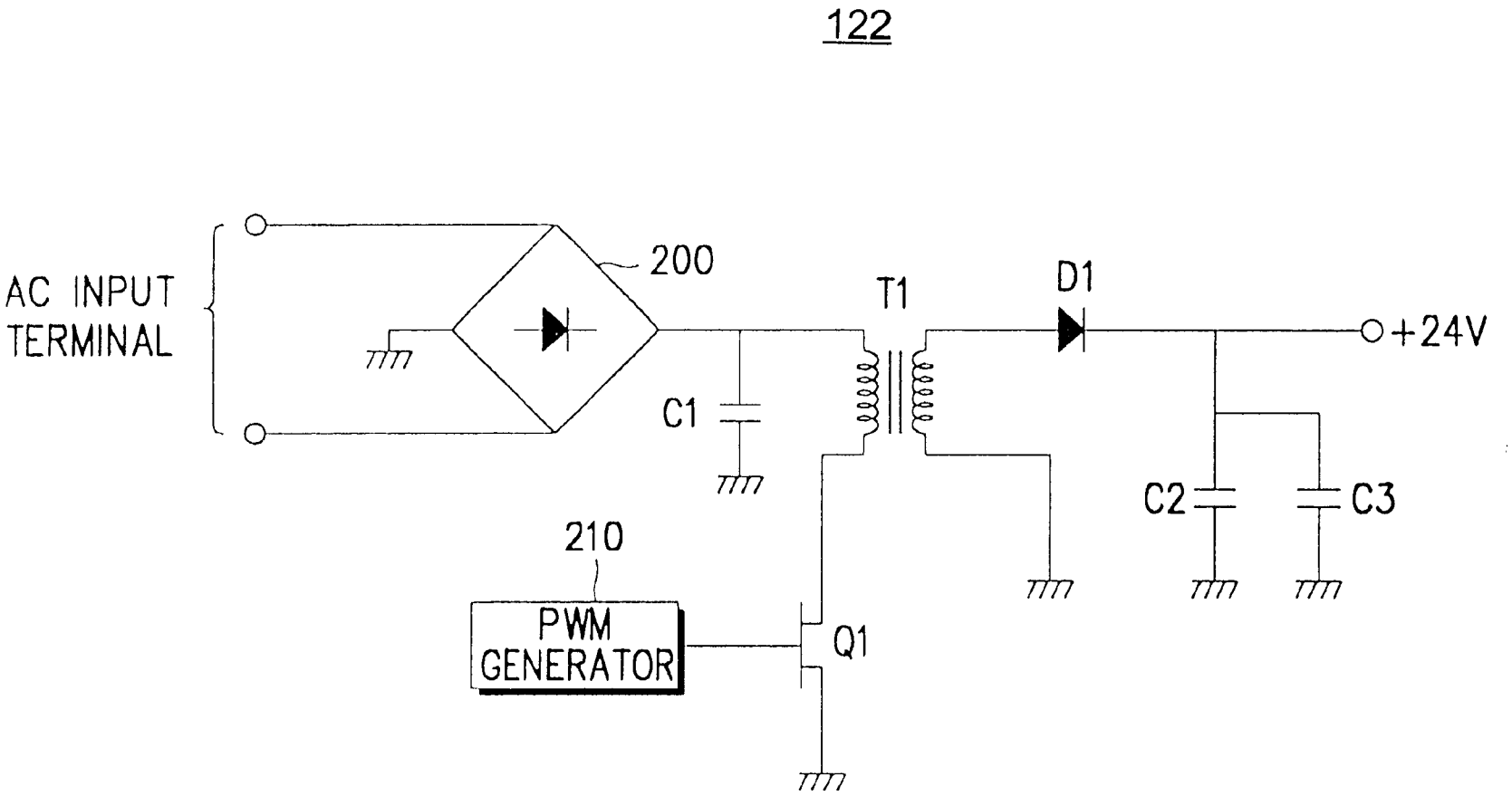
FIG. 2 is a detailed circuit diagram illustrating a power supply of FIG. 1, in accordance with the principles of the present invention.

FIG. 2 is a detailed circuit diagram illustrating the power supply 122 of FIG. 1. The power supply 122 shown in FIG. 2 is generally applicable to electronic products such as facsimile machines and printing systems. Moreover, the above power supply 122 can output the driving voltage requested for the ink-jet printer according to the voltage levels. However, FIG. 2 illustrates only a port for outputting the driving voltage +24 volts requested for the head conveying motor 110.

Turning now to FIG. 2, a bridge diode 200 full-rectifies and outputs the alternating current inputted through an alternating current input terminal. A capacitor C1 smooths and outputs the full-rectified voltage, with a diode included in the bridge diode 200. A transformer T1 induces the voltage applied to an input terminal thereof to an output terminal thereof according to an on/off state of a switching device Q1. A pulse width modulation (PWM) generator 210 generates the control signal which is pulse width modulated for control of the on/off state of the switching device Q1. A diode D1 cuts off an inverse current and, smooths and outputs the voltage inputted through an output terminal of the transformer T1, with the capacitors C2 and C3. In the meanwhile, the capacitors C1, C2, and C3 are charged when the normal power supply is applied according to the present invention.

When the alternating current is cut off, the charged voltage is discharged to thereby provide the head conveying motor 110 with the driving voltage necessary. As a result, the ink-jet head 114 can be transferred to its primary position. The primary position is also known as a home position. The transferral to the home position is sometimes referred to as the homing of the ink-jet head.

Figure 3:
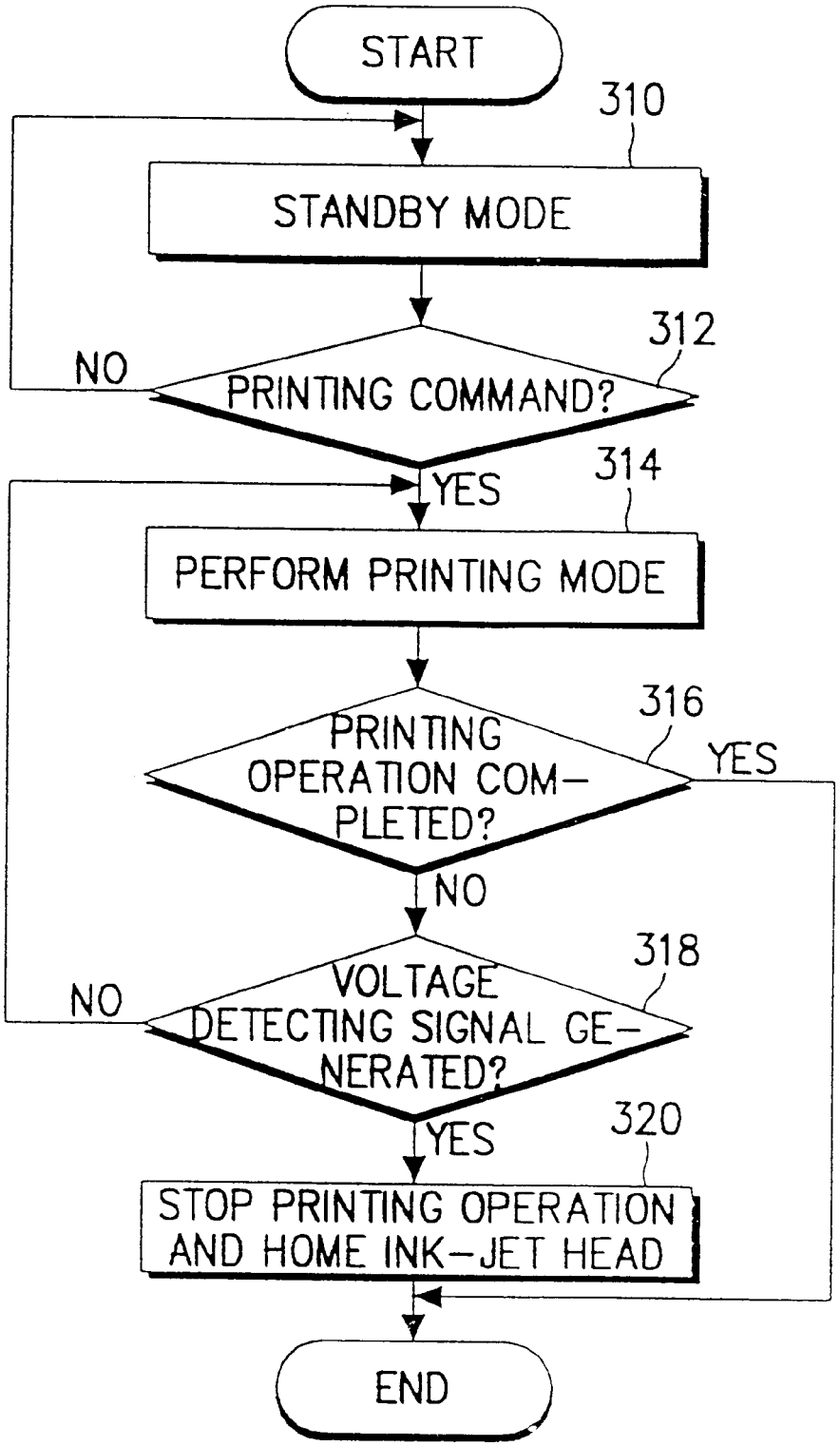
FIG. 3 is a flow chart illustrating steps for homing an ink-jet head in the ink-jet printer when the power supply is cut off, in accordance with the principles of the present invention.

FIG. 3 is a flow chart illustrating steps for homing an ink-jet head in the ink-jet printer when the power supply is cut off, according to the embodiment of the present invention, which includes the steps for transferring the ink-jet head to its primary position if the level of the voltage drops less than a predetermined voltage level during the printing operation.

Referring to the construction of the ink-jet printer as illustrated in FIGS. 1 and 2, a preferred embodiment of the present invention will be explained in detail according to the flow chart of FIG. 3.

At step 310, the central processing unit 100 maintains a standby mode state available for a normal printing operation when the driving voltage is provided from the power supply 122. Here, the standby mode state means a state capable of performing services of the ink-jet printer according to the key data inputted by the operator.

Referring now to FIG. 2, the procedure for providing the driving voltage from the power supply 122 will be briefly explained hereinafter. The alternating current inputted according to the power-on state is full rectified via the bridge diode 200. The full rectified voltage is smoothed by the diode included in the bridge diode 200 and capacitor C1. At this time, the capacitor C1 is charged with the voltage outputted from the bridge diode 200. In the meanwhile, the full rectified and smoothed voltage is applied to the input terminal of the transformer T1 and it is further induced to the output terminal thereof according to the switching device Q1 turned on or turned off by the pulse width modulation (PWM) signal outputted from the pulse width modulation (PWM) generator 210. The voltage induced to the output terminal of the transformer T1 is transmitted via the diode D1 and then it is charged to the capacitors C2 and C3. Besides, the alternating current component of the voltage induced to the output terminal of the transformer T1 is full rectified and than smoothed by the diode D1, and capacitors C1 and C2. The above full rectified and smoothed voltage is finally supplied to the head conveying motor 110 being as the driving voltage. Though FIG. 2 only illustrates the output voltage +24 volts supplied from the power supply 122, it would be well known to one of ordinary skill in the art that the output voltage could be changed through adjusting the coil of the output terminal of the transformer T1.

In the meanwhile, when the standby mode is set in step 310, the next step is step 312. At step 312, the central processing unit 100 checks whether there is any printing command applied from the relevant personal computer (not shown in FIG. 1) via the personal computer interface 108. Here, the above printing command is generated by the request of the operator to print the personal computer data. When checked in the step 312 that there was the printing command, the central processing unit 100 proceeds to step 314. At step 314, the printing mode is performed and the printing operation occurs. The above printing mode means the mode which is capable of performing the printing operation, through getting a supply of the personal computer data to be printed via the personal computer and then controlling the head conveying motor 110, the head driver 112, and the paper conveying motor 118. The aforesaid personal computer data to be printed is supplied from the personal computer via the personal computer interface 108. Here, since the procedure for controlling the head conveying motor 110, the head driver 112, and the paper conveying motor 118 is well known in the art, the explanation thereon will be omitted.

After step 314, then step 316 is performed. At step 316, the central processing unit 100 checks whether the printing operation is completed. Here, whether the printing operation is completed could be checked by a command requesting to complete the printing operation which is provided from the personal computer.

At step 316, when the printing operation is determined to have been completed, the central processing unit 100 ends its function. However, at step 316, when the printing operation is determined to have not yet been completed, step 318 is performed. At step 318, the central processing unit 100 checks whether the level of the driving voltage provided from the power supply 122 drops less than the minimal voltage level required to perform the printing operation due to the power failure. Here, the level of the driving voltage can be checked by the voltage detector 120. Further, whether the level of the driving voltage drops less than the minimal voltage level as required can be checked through comparing +5 volts of the driving voltages provided from the power supply 122 with the minimal voltage level +4.75 volts via the voltage detector 120. When the level of the above driving voltage +5 volts drops less than the minimal voltage level +4.75 volts, the voltage detecting signal V.D. having the low voltage level will be generated.

In the steps 316 and 318, when checked that the voltage detecting signal V.D. was not generated until the printing operation was completed, the central processing unit 100 completes the printing mode and returns to the step 310 in order to convert the printing mode into the standby mode. Here, completing the printing mode can be performed through the following procedure of controlling the head conveying motor 110 to thereby home the ink-jet head 114 and controlling the head driver 112 to thereby stop the driving of the ink-jet head 114.

The transfer of the ink-jet head 114 to the home position is also referred to as the homing of the ink-jet head 114. The ink-jet head 114 is transferred to the home position to prevent the nozzle of the ink-jet head 114 from being blocked up due to dried ink. When the ink-jet head 114 rests at the home position, the nozzles of the ink-jet head 114 do not become clogged due to dried ink. However, when the ink-jet head 114 rests at a position in the ink-jet printer other than the home position, the nozzles of the ink-jet head 114 can become clogged due to dried ink.

In FIG. 3, in the steps 316 and 318, when checked that the voltage detecting signal V.D. was generated before the printing operation was completed, the central processing unit 100 proceeds to step 320. At step 320, the central processing unit 100 controls the head driver 112 to stop the current printing operation and forcibly drives the head conveying motor 110 to home the ink-jet head 114. Here, the driving voltage required to forcibly drive the head conveying motor 110 to thereby home the ink-jet head 114, can be supplied thereto by use of the voltage charged in the capacitors C1 , C2, and C3, as shown in FIG. 2. Particularly, the printing systems or the facsimile machines applying a switching mode power supply type can itself provide each elements with the charged driving voltage for 1200 milliseconds in order to make preparations for the momentary power failure even when the alternating current is cut off. In the meanwhile, the ink-jet head 114 can be homed according to the strip variation detected by the encoder strip detector 116. The above encoder strip detector 116 detects the strip variation via the sensor when the ink-jet head 114 is transferred by the head conveying motor 110. Further, it can detect the position of the ink-jet head 114 through counting the number of the strip variation. Therefore, the central processing unit 100 uses the counter value in order to exactly home the ink-jet head 114 in the step 320.

As apparent from the foregoing, when the level of the driving voltage drops less than the minimal voltage level required to perform the printing operation, the present invention can compulsorily drive the head conveying motor to home the ink-jet head, thereby preventing the ink from unnecessarily being wasted due to the dried ink. Further, the present invention can effectively prevent the nozzle of the ink-jet head from being blocked up due to the dried ink to thereby prevent the image quality from being damaged when the printing operation can be performed continually after the normal driving voltage is supplied thereto.

While the present invention has been illustrated by the description of embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus and method, and illustrative examples shown and described. Accordingly, departures may be made from such details without departing from the spirit or scope of the applicant's general inventive concept.

What is claimed is:

1. A method, comprising:

conveying power from a source to a power supply;

when said conveying is performed, storing a second power in a storage unit and outputting at least a driving power and a first power from the power supply;

when said outputting of the driving power is performed, performing a printing operation with an image formation apparatus;

detecting a voltage level of at least one of the driving power and the first power; and when said detecting detects that the voltage level of at least one of the driving power and the first power drops below a predetermined level, transporting a print head of the image formation apparatus to a predetermined position by use of the stored second power and stopping said performing of the printing operation.

2. The method of claim 1, said drop in the first power below said predetermined level being detected by a voltage detector detecting a voltage level of said first power supplied by said power supply.

3. The method of claim 1, wherein said image formation apparatus comprises an inkjet printer.

4. The method of claim 1, wherein the printing operation includes transporting said print head across a surface of a recordable medium and jetting ink from said print head to the recordable medium to form an image on the recordable medium.

5. The method of claim 1, wherein said transporting of said print head to said predetermined position by use of the power stored in said storage unit reduces blockage of nozzles of said print head.

6. The method of claim 1, wherein said transporting of said print head to said predetermined position by use of the power stored in said storage unit reduces occurrence of dried ink blocking inkjet nozzles of said print head.

7. The method of claim 1, said storing of the second power in the storage unit corresponding to charging at least one capacitor, said transporting of the print head to the predetermined position by use of the stored second power corresponding to discharging the at least one capacitor.

8. A method, comprising:

conveying power from a source to a power unit;

when said conveying is performed, outputting a plurality of powers from the power unit including a driving power and a second power, performing a printing operation by an image formation apparatus with the driving power, and storing the second power in a storage unit;

detecting a voltage level of at least one of the plurality of powers; and when said detecting detects that the voltage level of at least one of the plurality of powers drops below a predetermined level, transporting a print head of the image formation apparatus to a predetermined position by use of the stored second power and stopping said performing of the printing operation.

9. The method of claim 8, further comprising detecting a position of a print head of said image formation apparatus, said checking being performed by a voltage detector.

10. The method of claim 9, wherein said image formation apparatus comprises an inkjet printer.

11. The method of claim 10, wherein the printing operation includes transporting said print head across a surface of a recordable medium and jetting ink from said print head to the recordable medium to form an image on the recordable medium.

12. The method of claim 10, wherein said transporting of said print head to said predetermined position by use of the power stored in said storage unit reduces blockage of nozzles of said print head.

13. The method of claim 11, wherein said transporting of said print head to said predetermined position by use of the power stored in said storage unit reduces occurrence of dried ink blocking inkjet nozzles of said print head.

14. An apparatus, comprising:

a power supply outputting at least a driving power and a first power, and storing a second power;

an image formation unit forming an image on a recordable medium when said power supply supplies said driving power to said image formation unit;

a print head of said image formation unit being positioned adjacent to a surface of the recordable medium to form said image on the recordable medium; and a detection unit detecting a voltage level of at least one of said driving power and said first power;

when said detection unit detects that said voltage level of said at least one of said driving power and said first power drops below a predetermined level, said print head being transported to a predetermined position by use of said second power stored by said power supply and said forming of the image being stopped;

said power supply conveying said driving power to said image formation unit when a power source outputs an output voltage, said power source being coupled to said power supply;

said power supply comprising at least one capacitor being disposed between said power source and a reference voltage, said at least one capacitor being charged and storing said second power when said power source outputs the output voltage, said at least one capacitor being discharged and supplying said second power to said image formation unit when said detection unit detects that said voltage level of said at least one of said driving power and said first power drops below a predetermined level.

15. The apparatus of claim 14, said at least one capacitor smoothing the output voltage received from said power source.

16. The apparatus of claim 15, said power supply further comprising:

a bridge diode receiving alternating current power from said power source and outputting full-rectified power, the alternating current power output from said power source corresponding to the output voltage output from said power source;

said at least one capacitor including at least a first capacitor and a second capacitor, said first capacitor being disposed between the reference voltage and said bridge diode, said first capacitor smoothing said full-rectified power received from said bridge diode;

a switch unit having an on position and an off position;

a pulse width modulator outputting a control signal to said switch unit, said control signal being pulse width modulated to switch on and switch off said switch unit; and a transformer having an input terminal and an output terminal, said input terminal being coupled to said first capacitor and said switch unit, said input terminal receiving said full-rectified power smoothed by said first capacitor, said transformer inducing a voltage at said output terminal according to said switch unit;

said second capacitor being disposed between the reference voltage and said output terminal of said transformer, said second capacitor smoothing said voltage induced at said output terminal of said transformer, said first and second capacitors being charged to store said second power when said bridge diode receives said alternating current power, said first and second capacitors being discharged to supply said second power to said image formation unit when said detection unit detects that said voltage level of said at least one of said driving power and said first power drops below a predetermined level.

17. The apparatus of claim 14, wherein said image forming unit corresponds to a unit selected from among a printer and a facsimile system.

18. The apparatus of claim 14, further comprising a video display conveying varying visual information to a user, said video display being selected from among a cathode ray tube, a liquid crystal display, a gas-plasma display, a light emitting diode display, an electro-luminescent display, and an field emission display.

19. An apparatus, comprising:

a power supply supplying a first power and storing a second power;

an image formation unit forming an image on a recordable medium when said power supply supplies said first power to said image formation unit;

a print head of said image formation unit being positioned adjacent to a surface of the recordable medium to form said image on the recordable medium; and a voltage detector detecting a voltage level of said first power supplied by said power supply;

said print head being transported to a predetermined position when said voltage detector detects that said voltage level of said first power supplied by said power supply drops below a predetermined level said print head being transported to said predetermined position by use of said second power stored by said power supply;

said power supply further comprising:

a bridge diode receiving alternating current power and outputting full-rectified power;

a first capacitor disposed between a reference voltage and said bridge diode, said first capacitor smoothing said full-rectified power received from said bridge diode;

a switch unit having an on position and an off position;

a pulse width modulator outputting a control signal to said switch unit, said control signal being pulse width modulated to switch on and switch off said switch unit;

a transformer having an input terminal and an output terminal, said input terminal being coupled to said first capacitor and said switch unit, said input terminal receiving said full-rectified power smoothed by said first capacitor, said transformer inducing a voltage at said output terminal according to said switch unit;

a diode having an anode and a cathode, said anode being coupled to said output terminal of said transformer and receiving said voltage induced at said output terminal, said diode cutting off an inverse current, said cathode being coupled to said image formation unit to transmit said voltage to said image formation unit, wherein said voltage corresponds to said first power;

a second capacitor disposed between the reference voltage and said cathode of said diode;

a third capacitor disposed between the reference voltage and said cathode of said diode, said second and third capacitors smoothing said voltage induced at said output terminal of said transformer;

said first, second, and third capacitors being charged to store said second power when said bridge diode receives said alternating current power; and said first, second, and third capacitors being discharged to supply said second power to said image formation unit when said bridge diode does not receive said alternating current power.

20. The apparatus of claim 16, said at least one capacitor further including at least a third capacitor, said third capacitor being disposed between the reference voltage and said output terminal of said transformer, said third capacitor smoothing said voltage induced at said output terminal of said transformer, said first, second, and third capacitors being charged to store said second power when said bridge diode receives said alternating current power, said first, second, and third capacitors being discharged to supply said second power to said image formation unit when said detection unit detects that said voltage level of said at least one of said driving power and said first power drops below a predetermined level.

* * * * *